US011939770B2

(12) United States Patent
Wenzel et al.

(10) Patent No.: US 11,939,770 B2
(45) **Date of Patent: *Mar. 26, 2024**

(54) METAL SHINGLE AND SNOW GUARD APPARATUS

(71) Applicant: I.E.L. MANUFACTURING LTD., Delta (CA)

(72) Inventors: Mark Wenzel, Delta (CA); Charles Evans, Delta (CA)

(73) Assignee: I.E.L. MANUFACTURING LTD., British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/110,466

(22) Filed: Feb. 16, 2023

(65) Prior Publication Data

US 2023/0193632 A1 Jun. 22, 2023

Related U.S. Application Data

(63) Continuation of application No. 17/361,846, filed on Jun. 29, 2021, now Pat. No. 11,603,664.

(60) Provisional application No. 63/061,535, filed on Aug. 5, 2020, provisional application No. 63/046,096, filed on Jun. 30, 2020.

(51) Int. Cl.

| | |
|---|---|
| ***E04D 13/10*** | (2006.01) |
| ***E04D 1/00*** | (2006.01) |
| ***E04D 1/18*** | (2006.01) |
| *E04D 1/34* | (2006.01) |

(52) U.S. Cl.

CPC ..... *E04D 13/10* (2013.01); *E04D 1/18* (2013.01); *E04D 1/2916* (2019.08); *E04D 1/2918* (2019.08); *E04D 1/2942* (2019.08); *E04D 1/34* (2013.01); *E04D 2001/3423* (2013.01); *E04D 2001/3458* (2013.01); *E04D 2001/3494* (2013.01)

(58) Field of Classification Search

CPC ..... E04D 13/10; E04D 1/18; E04D 1/2916; E04D 1/2918; E04D 1/2942; E04D 1/34; E04D 2001/3423; E04D 2001/3458; E04D 2001/3494

See application file for complete search history.

(56) References Cited

U.S. PATENT DOCUMENTS 3,347,001 A * 10/1967 Cosden ..... E04D 3/363 52/522

* cited by examiner

*Primary Examiner* — Patrick J Maestri
(74) *Attorney, Agent, or Firm* — Dinsmore & Shohl LLP

(57) ABSTRACT

A metal shingle having a body with left, right, top and bottom parts. The body is substantially planar and rectangular and has a front, a rear, left and right sides, a top and a bottom. The left and right parts extend from the left and right side respectively. One of the left and right parts is folded over the front and the other is folded over the bottom. The top and bottom parts extend from the top and bottom respectively. One of the top and bottom parts is folded over the front and the other is folded over the bottom. In use, the shingles are positioned in each of side-to-side and top-to-bottom abutting relation so that adjacent sides are interlocked. The body defining a hollow adjacent to one of the interlocking top and bottom parts.

11 Claims, 8 Drawing Sheets

METAL SHINGLE AND SNOW GUARD APPARATUS

CROSS-REFERENCE TO RELATED APPLICATIONS

This Application is a continuation of and claims the benefit of U.S. Ser. No. 17/361,846 filed Jun. 29, 2021. The '846 application in turn claims the benefit of U.S. Provisional Application 63/061,535 filed on Aug. 5, 2020. The '846 application also in turn claims the benefit of U.S. Provisional Application 63/046,096 filed on Jun. 30, 2020.

FIELD OF THE INVENTION

The invention relates to the field of roofing shingles.

BACKGROUND OF THE INVENTION

Interlocking metal shingles are well known, as are snow guards for use therewith.

SUMMARY OF THE INVENTION

Forming one aspect of the invention is a shingle having a body, a left part, a right part, a top part and a bottom part. The body is rectangular and has a front, a rear, a left side, a right side, a top and a bottom. The body defines a hollow adjacent one of the top and bottom parts.

The left part extends from the left side and a right part extending from the right side, one of the left part and right part being folded over the front and the other of the left part and right part being folded over the rear. The top part extends from the top and a bottom part extends from the bottom, one of the top part and bottom part being folded over the front and having the hollow positioned adjacent thereto, the other of the top part and bottom part being folded over the rear.

The body is substantially planar and the left, right, top and bottom parts are shaped and dimensioned such that an array of the shingles can be positioned, further such that in respect of any pair of shingles in such array, these being positioned in each of a side-to-side abutting relationship with adjacent sides being interlocked, as well as in a top-to-bottom abutting relation, and so that the abutting top part and bottom part of the shingles are likewise interlocked.

According to another aspect, the hollow defined in the body can extend beneath the one of the top and bottom parts that is folded over the front.

According to another aspect, the one of the top and bottom parts that are folded over the front can have defined therein a nailing aperture for receiving a roofing nail.

According to another aspect, the one of the top and bottom parts that is folded over the front can be the top part.

Forming another aspect of the invention is an apparatus for use with the shingle, this apparatus including each of a clip and a protuberant portion, such that the clip is adapted to engage with the one of the top and bottom parts that is folded over the front and the protuberant portion is connected to the clip to define, in use, a snow guard.

According to another aspect, the clip can include a seat portion that, in use, occupies that portion of the hollow that extends beneath the one of the top and bottom parts that is folded over the front. The clip also includes a cover that, in use, is disposed in overlapping, close-fitting relation to the one of the top and bottom parts that is folded over the front.

According to another aspect, the cover portion can have defined therein an aperture which communicates with the nailing aperture.

According to another aspect, the tab can extend from the cover portion and can have nailing apertures therein.

The shingle and apparatus can be used in a method that forms another aspect of the invention. The method includes the steps of securing the shingle to the roof and positioning the clip apparatus such that the seat portion occupies that portion of the hollow that extends beneath the one of the top and bottom parts that is folded over the front, and the cover is disposed in an overlapping, close-fitting relation to the one of the top and bottom parts that is folded over the front.

Other steps include nailing the apparatus to the roof and interlocking the bottom part of a further shingle with the upper part of the shingle and the clip.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
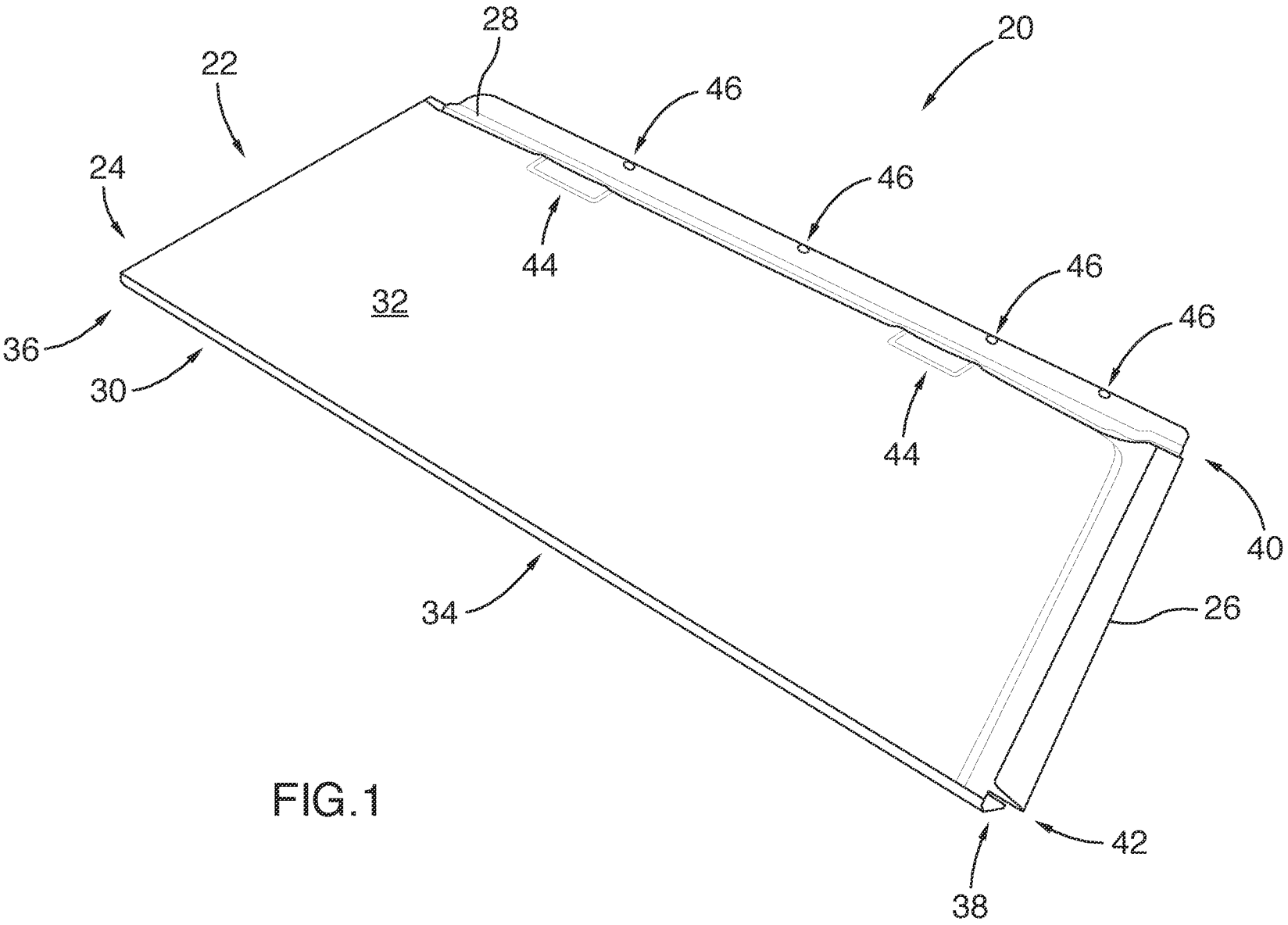
FIG. 1 is a perspective illustration of the shingle body according to the present invention.
Figure 2:
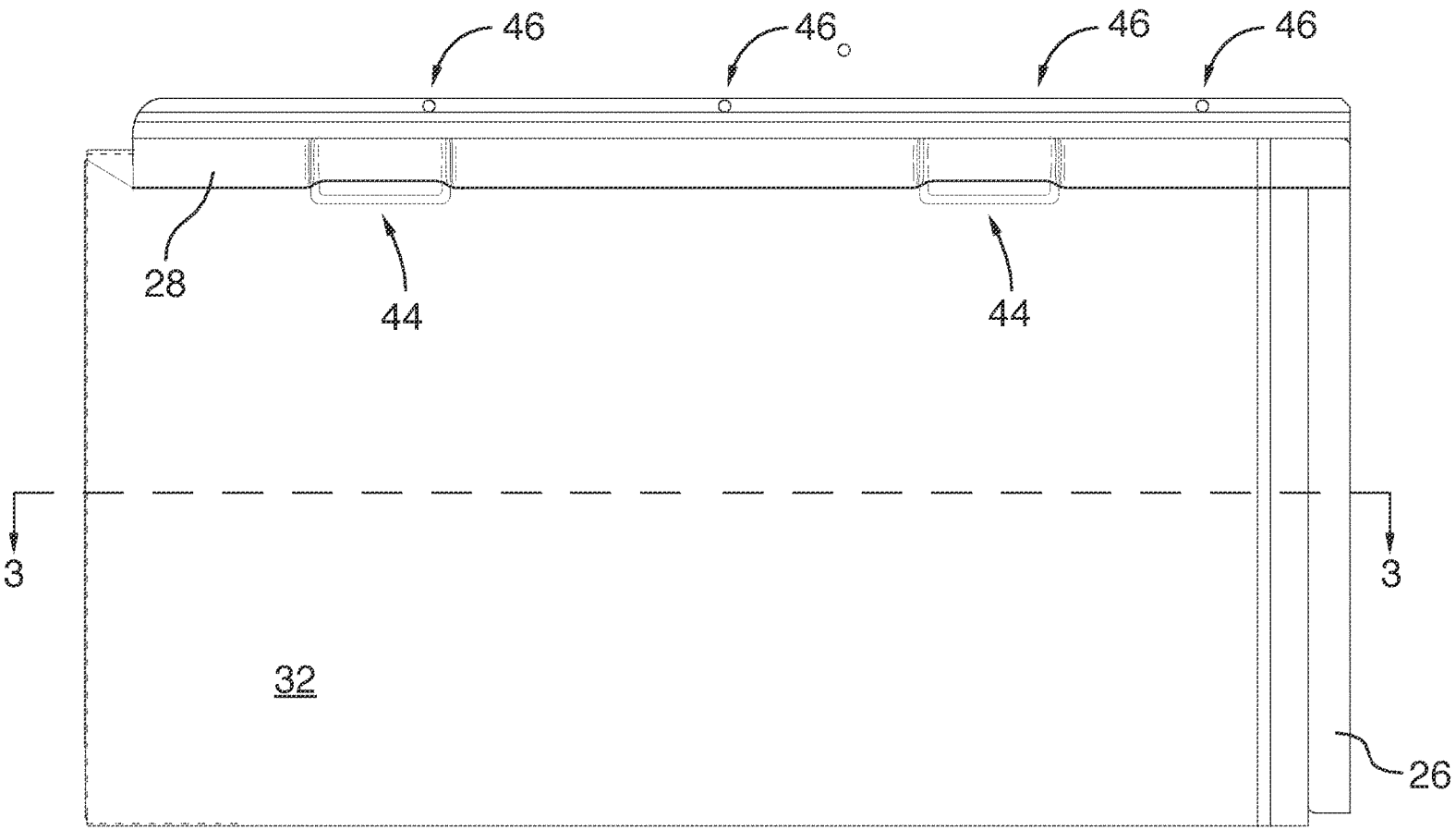
FIG. 2 is a front plan view of the shingle body of FIG. 1.
Figure 3:
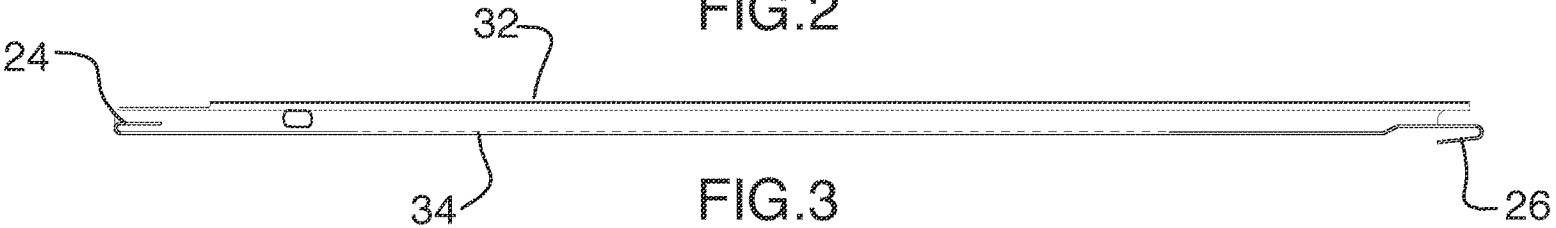
FIG. 3 is a cutaway view taken along line 3-3 of the shingle body of FIG. 2.
Figure 4:
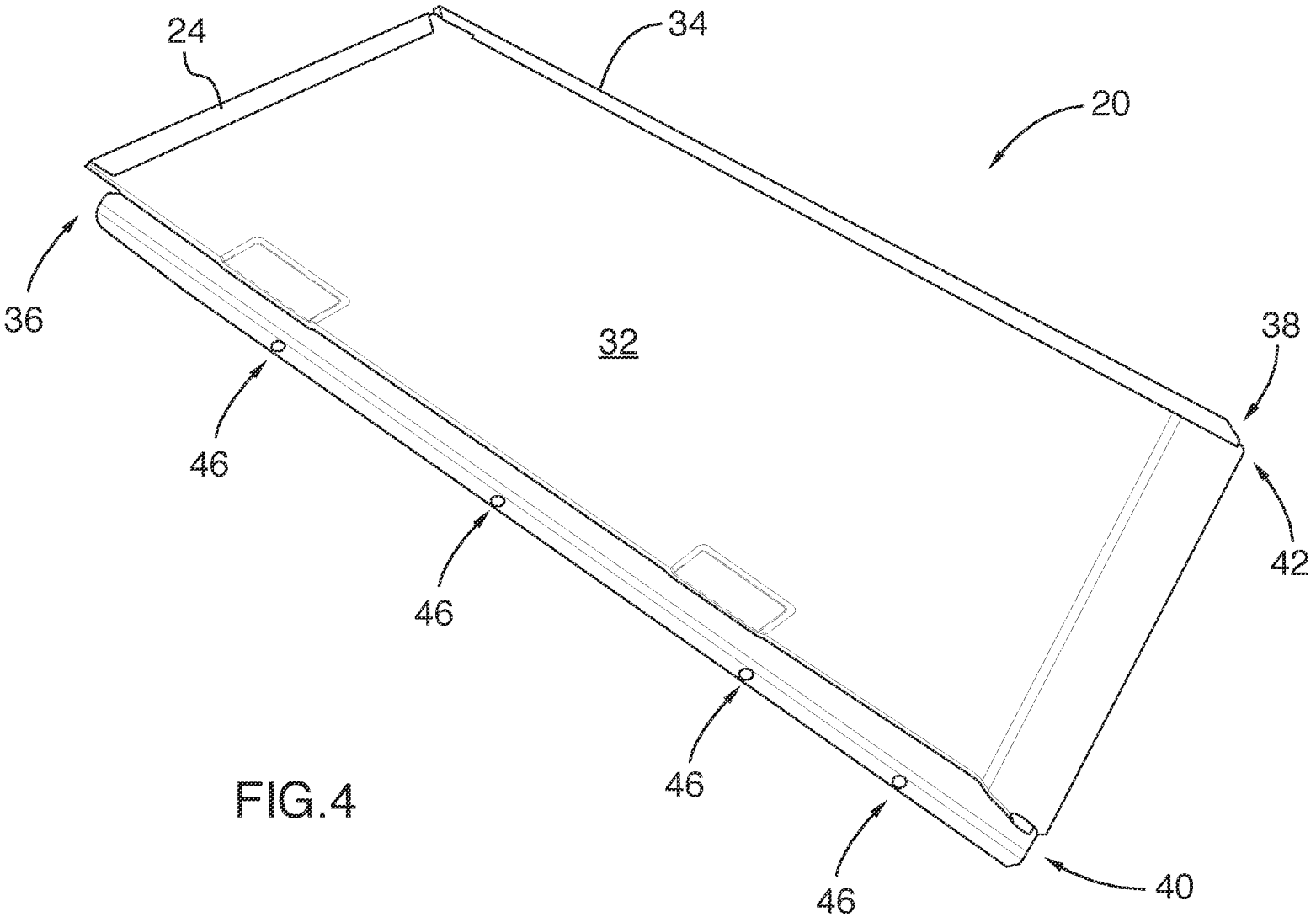
FIG. 4 is a one hundred and eighty degree rotated perspective view of the shingle body of FIG. 1.
Figure 5:
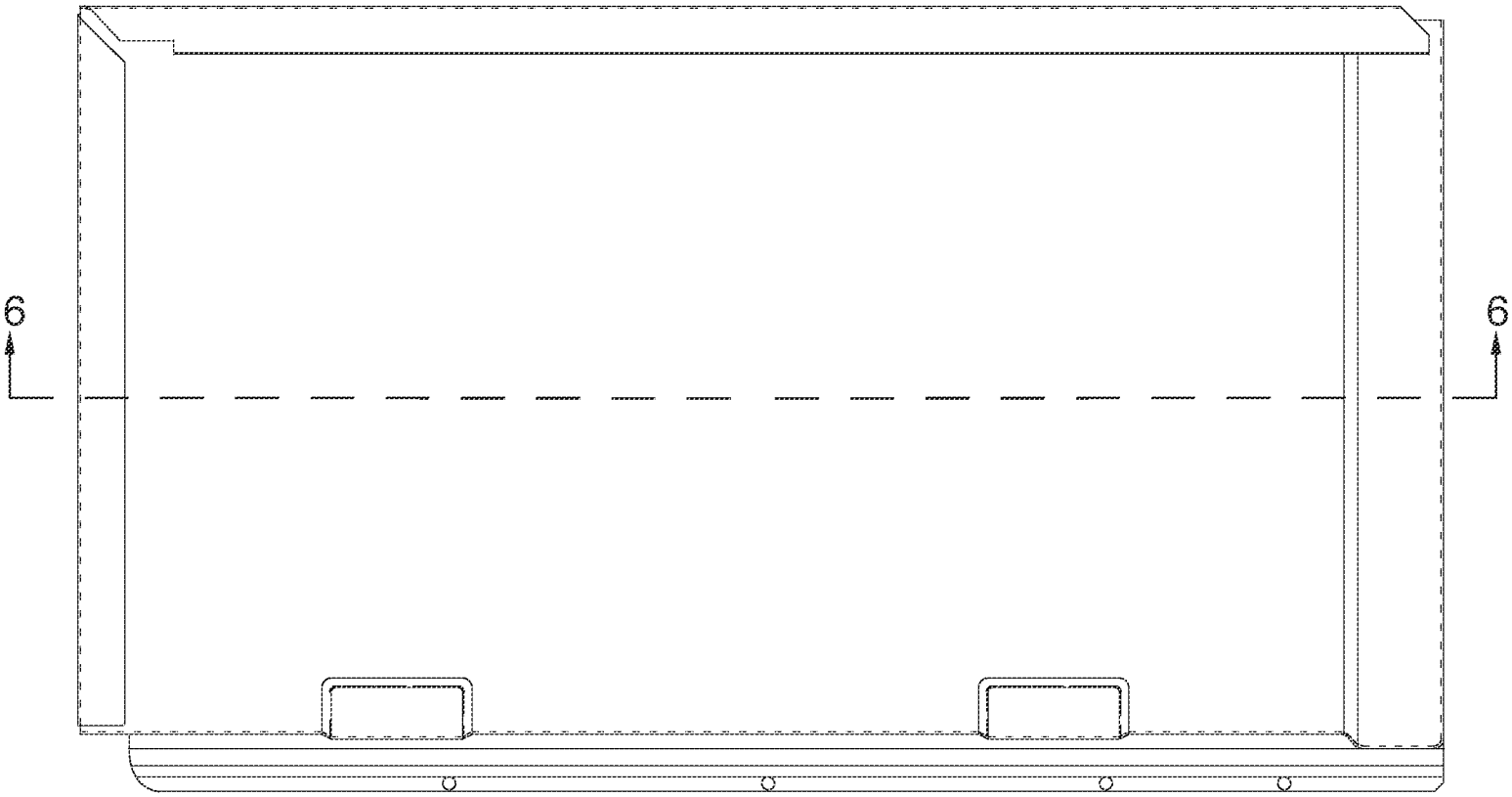
FIG. 5 is a front plan view of the shingle body of FIG. 4.
Figure 6:
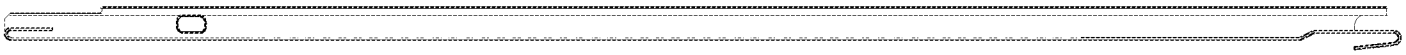
FIG. 6 is a cutaway view taken along line 6-6 of FIG. 5.

With reference to the attached figures, a shingle (generally at 20) is depicted according to one embodiment of the invention and is shown in FIGS. 1-6. The shingle includes a body 22 having each of a left part 24, a right part 26, a top part 28 and a bottom part 30.

The body 22 is rectangular in shape and has a front 32, a rear 34, a left side 36, a right side 38, a top 40 and a bottom 42. As shown, the left part 24 extends from the left side 36 and the right part 26 extends from the right side 38 (see also interconnected side-to-side abutting relationship of FIG. 13). As further shown, the top part 28 extends from the top 40 and the bottom part 30 extends from the bottom 42.

As further shown, one of the left part 24 and right part 26 of the shingle body is folded over the front 32 and the other of the left part and right part is folded over the rear 34. More particularly, in this embodiment, the right part 26 is folded over the front 32 and the left part 24 is folded over the rear 34 (see again FIG. 13).

Similarly, one of the top part 28 and bottom part 30 is folded over the front 32 and the other of the top part and bottom part is folded over the rear 34. More particularly, in this embodiment, the top part 28 is folded over the front 32 and the bottom part 30 is folded over the rear 34.

As further best shown, the shingle body 22 is seen to be substantially planar and solid, except for hollow locations 44 defined adjacent to and extending beneath the top part 28 and can be folded over the front 32 of the shingle body 22. Alternatively, and although not shown, the hollow locations 44 can be redesigned so that they are defined adjacent to and extending behind the bottom part 30 so that they are folded over the rear 34.

Also shown are nailing apertures 46 (shown formed at spaced intervals along the top part 28 folded over the front 32) for receiving roofing nails. Although not shown, the apertures can be relocated along the bottom part 30 within the scope of the invention.

Figure 11:
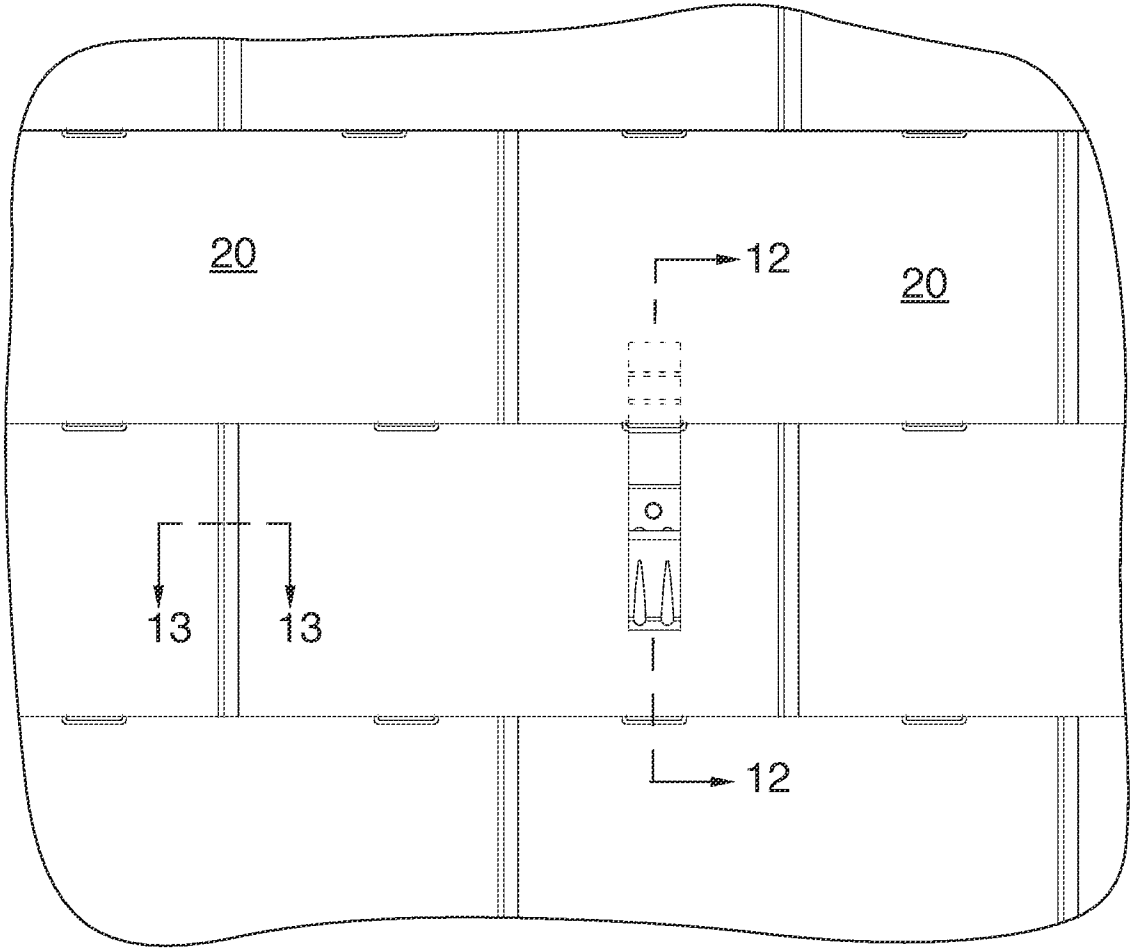
FIG. 11 is an environmental view illustrating a roof construction depicting a plurality of shingles and snow guards according to the present invention and in each of side-to-side and top-to-bottom abutting relation so that adjacent sides are interlocked.

In use, the shingle 20 can be disposed in a generally conventional manner, namely, in an array wherein, in respect of any pair of shingles being arrayed in a side-to-side abutting relationship as shown in FIG. 11, and in which the adjacent sides are interlocked. Additionally, and in respect to any pair of shingles arranged in a top-to-bottom abutting relation, the abutting top part 28 and bottom part 30 are interlocked. This type of interlocking relationship is well-known and as such, neither illustrated nor described in detail.

Figure 9:
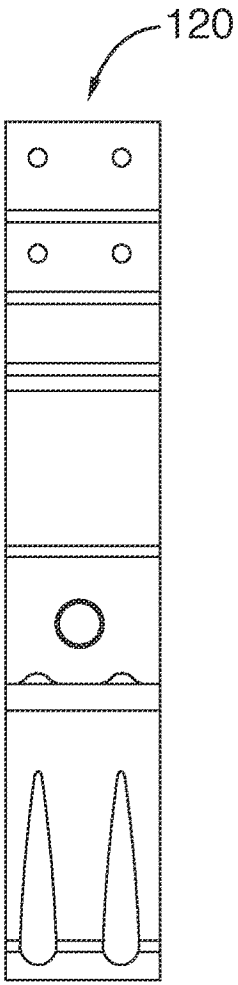
FIG. 9 is a front view of the clip of FIG. 7.
Figure 8:
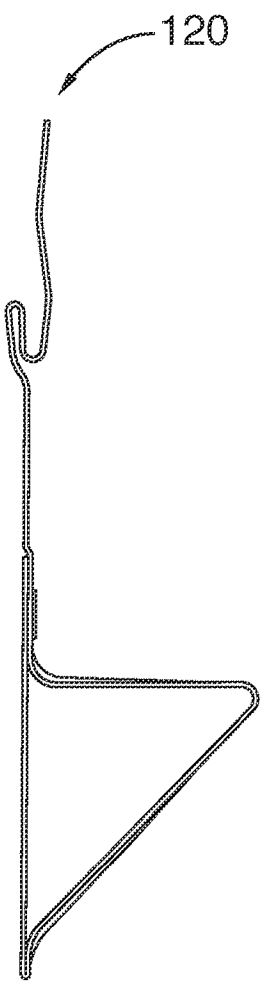
FIG. 8 is a side view showing the clip of FIG. 7.
Figure 7:
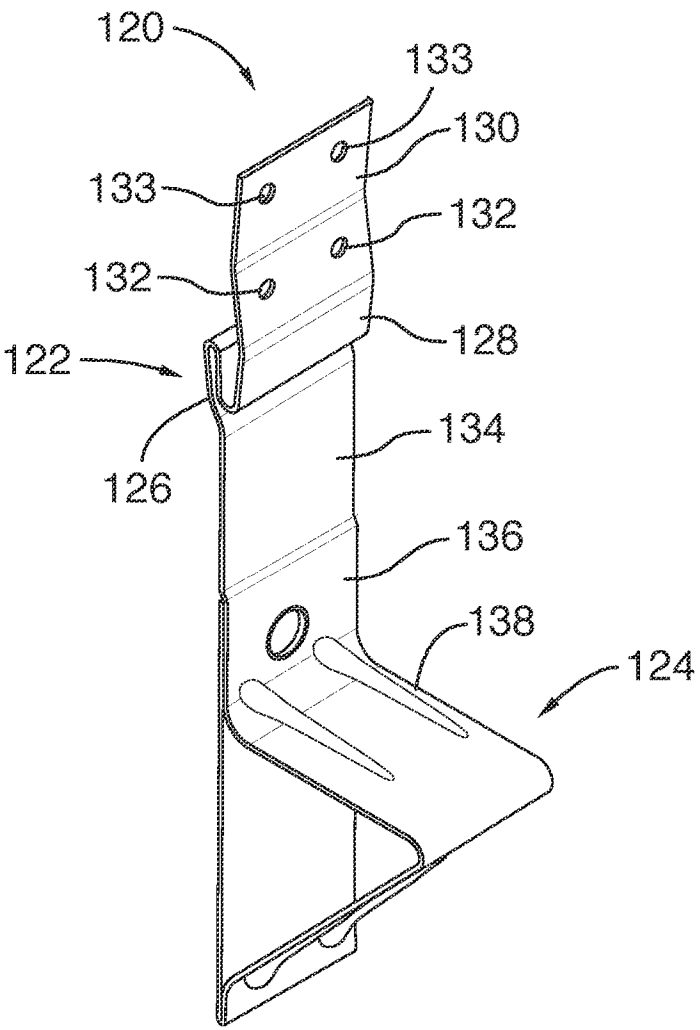
FIG. 7 is a perspective view of a clip with protuberant portion for attachment to the shingle body.

With reference to FIGS. 7-9, a further embodiment of the invention provides an apparatus (generally at 120) in the form of a clip having a body 122 incorporating a protuberant portion 124. The clip body 122 includes a seat portion 126, a cover portion 128 and a tab portion 130. The seat portion 126 is generally planar as shown. The cover portion 128 is an extension of the seat portion 126 that is folded-over the seat portion, which is further folded to protect outwardly therefrom and then to project over and beyond the seat portion. The cover portion has apertures 132 formed therein. The tab portion 130 has apertures 133 and extends from the cover portion 128.

The protuberant portion 124 extends from the clip body 122 and includes a portion 134 that extends from the seat portion 126 to a stepped portion 136, and a portion 138 is shown that is secured upon itself to define a triangular wedge.

Figure 10:
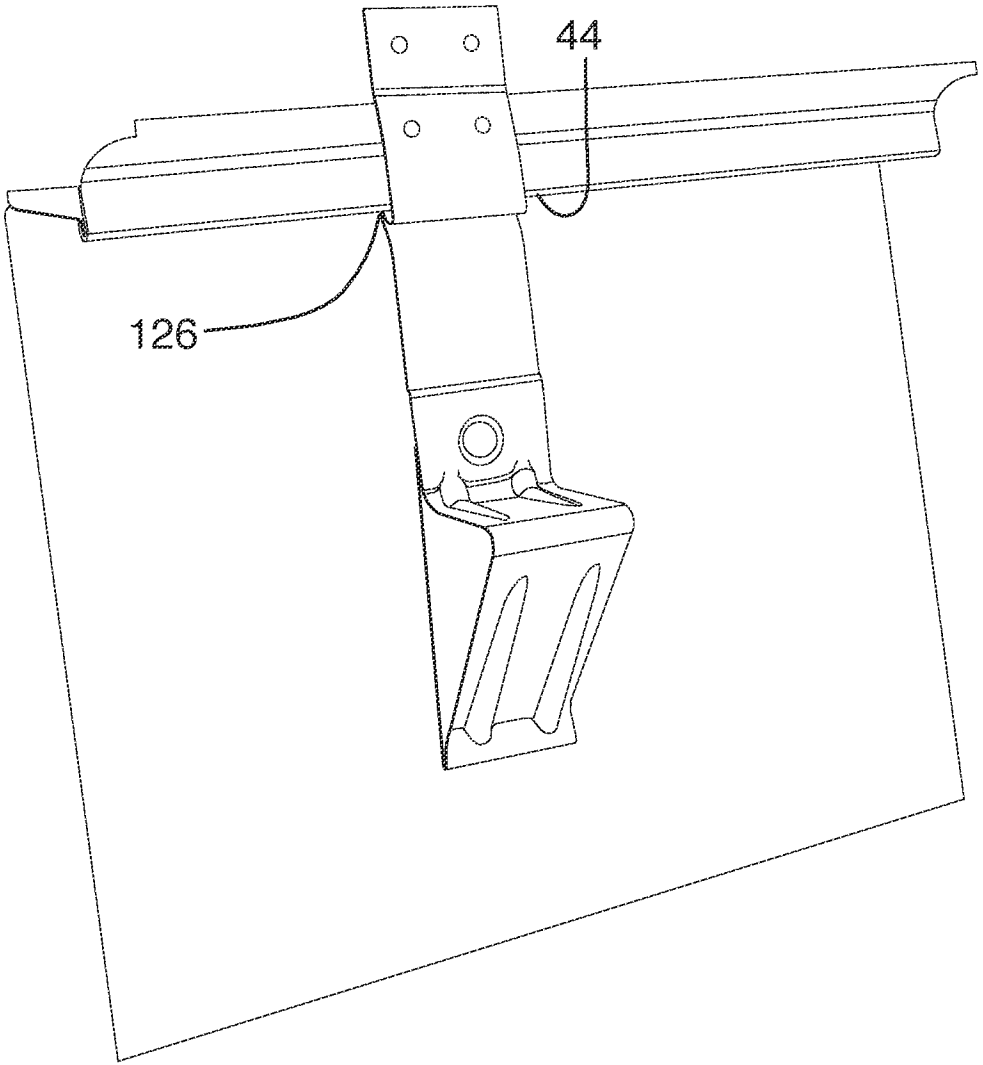
FIG. 10 is an illustration of the clip of FIG. 7 in which a seat portion occupies a portion of the shingle body hollow that extends beneath the one of the top and bottom parts that is folded over the front.

The clip can be positioned as shown in FIG. 10, wherein the seat portion 126 occupies that portion of the hollow 44 that extends beneath the one of the top 28 (as shown) or bottom 30 parts that is folded over the front, with the cover portion 128 disposed in overlapping, close-fitting relation to the top part 28 (or in a non-illustrated embodiment arranged in a similar arrangement with the bottom part 30) and that is folded over the front so that the tab portion 130 extends in substantially planar relation.

Proceeding to FIG. 11, an environmental view is an environmental view showing a roof construction using a plurality of shingles 20 and snow guards arranged in each of side-to-side and top-to-bottom abutting relation so that adjacent sides are interlocked. As illustrated, the lines of the shingles are straight and don't deform to any significant degree by the interposition of the snow guards, this in contrast to the prior art.

Figure 12:
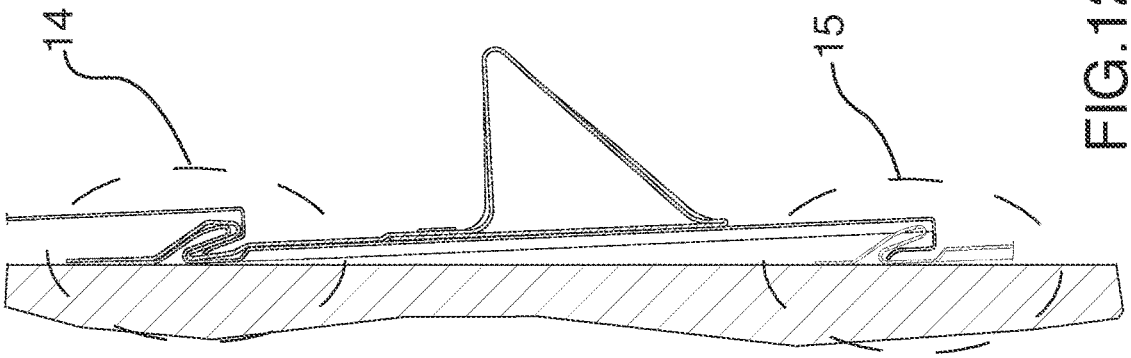
FIG. 12 is a cutaway view taken along line 12-12 of the clip in FIG. 11.

FIG. 12 is a side cutaway view the clip taken along cutaway line 12-12 in FIG. 11, secured to a redesigned top part of a shingle body. The clip is similar in overall construction with a similarly configured seating portion, cover portion and tab portion.

Figure 13:
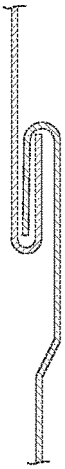
FIG. 13 is a cutaway view taken along line 13-13 in FIG. 11 illustrating a side-to-side abutting relationship established between respective left and right parts of adjoining shingle bodies.

FIG. 13 is a cutaway view taken along line 13-13 of FIG. 11 of a side-to-side abutting relationship established between respective left and right parts of adjoining shingle bodies also shown in FIG. 11.

Figure 14:
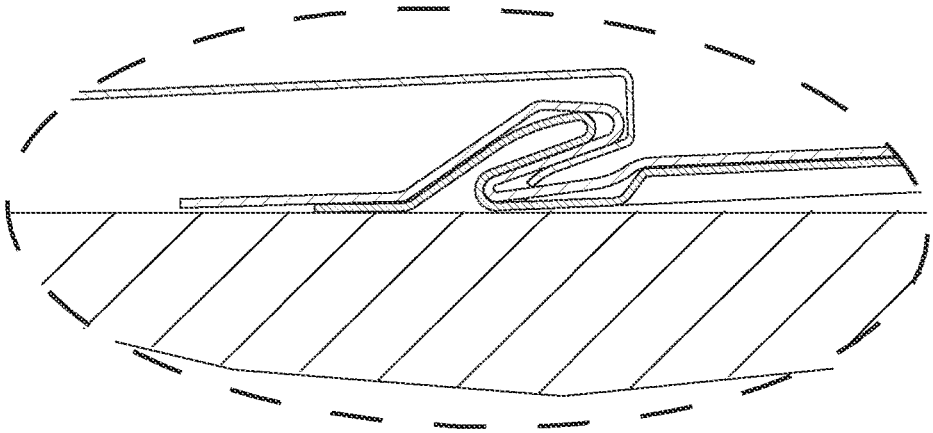
FIG. 14 illustrates enlarged area 14 in FIG. 12 depicting a bottom portion of an upper adjoining shingle engaging the seat portion of the clip attached to a lower adjoining shingle.

FIG. 14 illustrates an enlarged area 14 in FIG. 12 depicting a bottom portion of a redesigned upper adjoining shingle engaging the seat portion of the clip attached to a lower adjoining shingle (see again FIG. 11).

Figure 15:
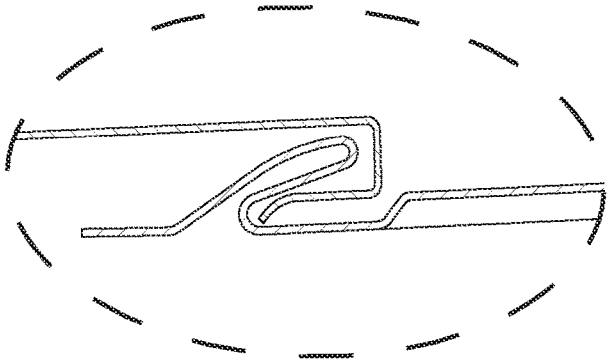
FIG. 15 illustrates enlarged area 15 in FIG. 12 and depicting interconnecting portions established between a redesigned lower portion of the clip in FIG. 12 and an engaging portion secured to the shingle body.

FIG. 15 illustrates an enlarged area 15 in FIG. 12 and depicting interconnecting portions (see first clip portion secured to the front of the shingle body and inter-engaging second clip portion defining a bottom portion of the clip).

The present invention also discloses a method for use with the shingle and the attachment clip apparatus forming yet another embodiment of the invention. The method includes the steps of the shingle secured to a roof and positioning the clip apparatus such that the seat portion occupies that portion of the hollow location that extends beneath the one of the top and bottom parts that is folded over the front, with the cover portion of the clip disposed in an overlapping, close-fitting relation to the one of the top and bottom parts that is folded over the front.

Other steps include nailing the apparatus to the roof and interlocking the bottom part of a further shingle with the upper part of the shingle and the clip. The apertures in the cover are aligned with the apertures in the shingle and, in this fashion, the bottom part of a further shingle is interlocked with the upper part of the shingle and the clip.

The method results in a shingled roof with snow guards wherein the alignment of the shingles is not materially prejudiced by the interposition of the snow guards, all as shown again in FIGS. 11-15.

It will be appreciated that, in this embodiment, the tab can be nailed to the roof, with the body tightly sandwiched between the seat and the roof and the cover defines a substantially smooth extension of the top part of the shingle (but for the deformed portion). Thus, the mechanical connection between the snow guard and the roof is relatively solid, there is relatively little or no buckling of the shingles associated with the snow guards and the alignment of the shingles in the array is not materially prejudiced.

Having described my invention, other and additional preferred embodiments will become apparent to those skilled in the art to which it pertains, and without deviating from the scope of the appended claims.

The detailed description and drawings are further understood to be supportive of the disclosure, the scope of which being defined by the claims. While some of the best modes and other embodiments for carrying out the claimed teachings have been described in detail, various alternative designs and embodiments exist for practicing the disclosure defined in the appended claims.

The invention claimed is:

1. A metal shingle comprising:

a rectangular body having a front, a rear, a left side, a right side, a top and a bottom;

a left part extending from the left side and a right part extending from the right side, one of the left part and right part being folded over the front and the other of the left part and right part being folded over the rear; and a top part extending from the top and a bottom part extending from the bottom, one of the top part and bottom part being folded over the front and the other of the top part and bottom part being folded over the rear, wherein the body is substantially planar and the left, right, top and bottom parts are shaped and dimensioned such that an array of the shingles can be positioned such that in respect of any pair of shingles in such array in side to side abutting relation, the adjacent sides are interlocked, and in respect of any pair of shingles in top-to-bottom abutting relation, the abutting top part and bottom part are interlocked; and wherein the body defines a hollow location adjacent the one of the top and bottom parts that is folded over the front.

2. The shingle of claim 1, wherein the hollow location extends beneath the one of the top and bottom parts that is folded over the front.

3. The shingle of claim 1, wherein the one of the top and bottom parts that is folded over the front is the top part.

4. A combination metal shingle and clip apparatus, comprising:

a rectangular shaped shingle body having a front, a rear, a left side, a right side, a top and a bottom;

a left part extending from the left side of the shingle body and a right part extending from the right side, one of the left part and right part being folded over the front and the other of the left part and right part being folded over the rear; and a top part extending from the top and a bottom part extending from the bottom, one of the top part and bottom part being folded over the front and the other of the top part and bottom part being folded over the rear, wherein the shingle body is substantially planar and the left, right, top and bottom parts are shaped and dimensioned such that an array of the shingles can be positioned such that in respect of any pair of shingles in such array in side to side abutting relation, the adjacent sides are interlocked, and in respect of any pair of shingles in top-to-bottom abutting relation, the abutting top part and bottom part are interlocked;

wherein the body defines a hollow location adjacent the one of the top and bottom parts that is folded over the front;

a clip adapted to engage with the one of the top and bottom parts of the shingle body that is folded over the front; and a protuberant portion connected to the clip to define, in use, a snow guard.

5. The combination shingle and clip apparatus of claim 4, wherein the hollow location extends beneath the one of the top and bottom parts that is folded over the front.

6. The combination shingle and clip apparatus of claim 5, wherein said clip further comprises:

a seat portion that, in use, occupies that portion of the hollow that extends beneath the one of the top and bottom parts that is folded over the front; and a cover portion that, in use, is disposed in overlapping, close-fitting relation to the one of the top and bottom parts that is folded over the front.

7. The combination shingle and clip apparatus of claim 5, wherein the one of the top and bottom parts of the shingle body that is folded over the front has defined therein a nailing aperture for receiving a roofing nail.

8. The combination shingle and clip apparatus of claim 7, further comprising said cover portion having an aperture defined therein which communicates with the nailing aperture.

9. The combination shingle and clip apparatus of claim 5, further comprising a tab portion that extends from the cover portion of said clip.

10. A method for installing a shingle and a clip upon a roof, comprising the steps of:

securing a shingle body to a roof, the shingle body having a body front, a rear, a left side, a right side, a top and a bottom, a left part extending from the left side;

forming a hollow location adjacent one of the top and bottom parts of the shingle body that is folded over the front;

adapting the clip to engage with the one of the top and bottom parts of the shingle body that is folded over the front;

forming a seat portion in the clip that, in use, occupies that portion of the hollow that extends beneath the one of the top and bottom parts that is folded over the front; and a cover portion that, in use, is disposed in overlapping, close-fitting relation to the one of the top and bottom parts that is folded over the front forming a protuberant portion in the clip to define, in use, a snow guard;

positioning the clip such that a seat portion thereof occupies a portion of the hollow location that extends beneath the one of top and bottom parts of the shingle body and that is folded over the front;

disposing the cover in overlapping, close-fitting relation to the one of the top and bottom parts that is folded over the front; and nailing the clip to the roof.

11. The method according to claim 10, further comprising the step of nailing the clip to the roof such that the cover becomes substantially aligned with one of the top and bottom flap portions, except for a portion that is deformed by the cover.

* * * * *